US005668589A

United States Patent [19]

Kuwabara et al.

[11] Patent Number: 5,668,589

[45] Date of Patent: Sep. 16, 1997

[54] THERMAL RECORDING DEVICE WITH CONTROLLER FOR CORRECTING LASER BEAM INTENSITY

[75] Inventors: Takao Kuwabara, Ashigarakami-gun; Yoshihisa Usami, Fujinomiya; Toshitaka Agano, Ashigarakami-gun, all of Japan

[73] Assignee: Fuji Photo Film Co., Ltd., Kanagawa, Japan

[21] Appl. No.: 222,640

[22] Filed: Mar. 31, 1994

Related U.S. Application Data

[63] Continuation-in-part of Ser. No. 119,590, Sep. 13, 1993, abandoned.

[30] Foreign Application Priority Data

Sep. 11, 1992 [JP] Japan ..... 4-243425
Oct. 12, 1992 [JP] Japan ..... 4-272972

[51] Int. Cl.[6] ..... B41J 2/47

[52] U.S. Cl. ..... 347/253; 347/23

[58] Field of Search ..... 347/247, 253, 347/23; 355/209, 246

[56] References Cited

U.S. PATENT DOCUMENTS 4,626,096 12/1986 Ohtsuka et al. ..... 355/209
4,998,821 3/1991 Ohta et al. ..... 353/122

FOREIGN PATENT DOCUMENTS 50-23617 3/1975 Japan .
58-94494 6/1983 Japan .
61-291183 12/1986 Japan .
62-78964 4/1987 Japan .
62-77983 4/1987 Japan .
524219 2/1993 Japan .
5301447 11/1993 Japan .

*Primary Examiner*—Mark J. Reinhart
*Attorney, Agent, or Firm*—Sughrue, Mion, Zinn, Macpeak & Seas

[57] ABSTRACT

A thermal recording device scans a laser beam over a thermosensitive recording medium which comprises a support coated with a coloring agent, a color developer, and a light absorbing dye and produces a color having a density commensurate with the lever of a thermal energy applied thereto, thereby to record an image thereon. The thermal recording device has a laser beam applying mechanism for emitting and applying a laser beam modulated by an image to be recorded to the thermosensitive recording medium, a temperature or humidity detecting mechanism for detecting a temperature or humidity with respect to the thermosensitive recording medium, and a controller for correcting the intensity of the laser beam emitted by the laser beam applying mechanism based on the humidity detected by the humidity detecting mechanism.

24 Claims, 8 Drawing Sheets

THERMAL RECORDING DEVICE WITH CONTROLLER FOR CORRECTING LASER BEAM INTENSITY

This application is a continuation-in-part of application 08/119,590 filed Sep. 13, 1993, now abandoned.

BACKGROUND OF THE INVENTION

1. Field of the Invention

The present invention relates to a thermal recording device for recording an image or other information on a thermosensitive recording medium with a laser beam emitted from a laser beam generator.

2. Description of the Related Art

Thermal recording devices for applying a thermal energy to a thermosensitive recording medium to record an image or other information thereon are in widespread use. Some thermal recording devices employ a laser as a thermal energy source for high-speed recording operation (see, for example, Japanese laid-open patent publications Nos. 50-23617, 58-94494, 62-77983, and 62-78964).

There has been proposed a thermosensitive recording medium for recording a high-quality image thereon. The proposed thermosensitive recording medium comprises a support coated with a coloring agent, a color developer, and a light absorbing dye. The thermosensitive recording medium produces a color of a density which is commensurate with the level of a thermal energy applied thereto. There has also been proposed a thermal recording device which employs a laser beam to record an image on the proposed thermosensitive recording medium. For details, reference should be made to Japanese patent application No. 3-62684 and Japanese laid-open patent publication No. 5-24219.

The proposed thermosensitive recording medium has a thermosensitive layer that is produced by coating a support with a solution which is prepared by dissolving microcapsules containing a basic dye precursor, a color developer, and a light absorbing dye into an organic solvent that is hardly soluble or insoluble in water, and then dispersing an emulsified material into the mixture.

The basic-dye precursor produces a color by giving electrons or receiving protons as of an acid. The basic dye precursor is made of a compound which is usually substantially colorless and has a partial skeleton of lactone, lactam, sultone, spiropyran, ester, amide, or the like, which opens or cleaves upon contact with the color developer. Specific examples of the basic dye precursors include crystal violet lactone, benzoyl leucomethylene blue, malachite green lactone, rhodamine B lactam, 1,3,1-trimethyl-6'-ethyl-8'-butoxyindolinobenzospiropyran.

The color developer is made of a phenol compound, an organic acid or its metallic salt, an acid material such as hydroxybenzoic acid ester, or the like. The color developer should preferably have a melting point ranging from 50° C. to 250° C. In particular, phenol that is hardly soluble in water or an organic acid, whose melting point ranges from 60° C. to 200° C., is preferable for use as the color developer. Specific examples of the color developer are disclosed in Japanese laid-open patent publication No. 61-291183, for example.

The light absorbing dye should preferably absorb less light in a visible spectrum range and more light especially in an infrared spectrum range. Materials for the light absorbing dye which meets such a requirement include a cyanine dye, a phthalocyanine dye, pyrylium and thiopyrylium dyes, an azulenium dye, a squalilium dye, a metal complex dye containing such as Ni, Cr, or the like, naphthoquinone and antraquinone dyes, an indophenol dye, an indoaniline dye, a triphenylmethane dye, a triallylmethane dye, aminium and diimmonium dyes, and a nitroso compound. Of these materials are particularly preferable those which have a high light absorption ratio in a near-infrared spectrum range from 700 nm to 900 nm because of the fact that semiconductor lasers capable of emitting near-infrared radiation are in practical use.

The thermosensitive recording medium produces no color when exposed to thermal energy whose level is lower than a certain threshold, so that the thermosensitive recording medium can be kept in stable storage.

However, the thermosensitive recording medium is not maintained at a constant temperature as it depends on the environment in which it is used. If a laser beam is applied from a laser beam source to the thermosensitive recording medium without any concern over the temperature of the thermosensitive recording medium, then color density irregularities are developed on the thermosensitive recording medium, making it difficult to record a desired image thereon.

While an image or other information is being recorded on the thermosensitive recording medium, the humidity in the atmosphere in various sections, such as a recording unit, a thermosensitive recording medium storage unit, etc., of the thermal recording device tends to vary. When the humidity increases, the water content of the thermosensitive recording medium increases, resulting in an increase in the sensitivity thereof. As shown in FIG. 7 of the accompanying drawings, provided a laser beam of a constant power level is applied to record an image on the thermosensitive recording medium, the higher the humidity, the higher the density of the color which is produced on the thermosensitive recording medium. Consequently, when the humidity varies, the sensitivity of the thermosensitive recording medium varies, making it difficult for the thermosensitive recording medium to always record a desired gradation image.

SUMMARY OF THE INVENTION

It is therefore an object of the present invention to provide a thermal recording device for applying a laser beam to record an image on a thermosensitive recording medium which comprises a coloring agent, a color developer, and a light absorbing dye on a support and which produces a color of a density which is commensurate with the level of a thermal energy applied thereto, the thermal recording device being capable of recording images of constant density without density irregularities that would otherwise be caused by temperature changes of the thermosensitive recording medium and of recording images highly accurately at all times without being affected by changes in humidity.

According to the present invention, there is provided a thermal recording device for scanning a laser beam over a thermosensitive recording medium which comprises a support coated with a coloring agent, a color developer, and a light absorbing dye and produces a color having a density commensurate with the lever of a thermal energy applied thereto, thereby to record an image thereon, the thermal recording device comprising a laser beam applying mechanism for emitting and applying a laser beam modulated by an image to be recorded to the thermosensitive recording medium, a temperature detecting mechanism for detecting a temperature with respect to the thermosensitive recording medium, and a controller for correcting the intensity of the laser beam emitted by the laser beam applying mechanism based on the temperature detected by the temperature detecting mechanism.

The temperature detecting mechanism may comprise a temperature sensor for detecting the temperature of the thermosensitive recording medium.

Alternatively, the temperature detecting mechanism may comprise a first temperature sensor for detecting the temperature of the thermosensitive recording medium, and a second temperature sensor for detecting an ambient temperature in an atmosphere around the thermosensitive recording medium. The controller may estimate a temperature in an area where the laser beam is applied to the thermosensitive recording medium from a temperature gradient between the temperatures detected by the first and second temperature sensors, and correct the intensity of the laser beam emitted by the laser beam applying mechanism based on the estimated temperature.

According to the present invention, there is also provided a thermal recording device for scanning a laser beam over a thermosensitive recording medium which comprises a support coated with a coloring agent, a color developer, and a light absorbing dye and produces a color having a density commensurate with the lever of a thermal energy applied thereto, thereby to record an image thereon, the thermal recording device comprising a laser beam applying mechanism for emitting and applying a laser beam modulated by an image to be recorded to the thermosensitive recording medium, a humidity detecting mechanism for detecting a humidity with respect to the thermosensitive recording medium, and a controller for correcting the intensity of the laser beam emitted by the laser beam applying mechanism based on the humidity detected by the humidity detecting mechanism.

The humidity detecting mechanism may comprise a humidity sensor for detecting a humidity in an atmosphere in an area where the laser beam is applied to the thermosensitive recording medium.

Alternatively, the humidity detecting mechanism may comprise a first humidity sensor for detecting a humidity in an atmosphere in an area where the laser beam is applied to the thermosensitive recording medium, and a second humidity sensor for detecting a humidity in a magazine for storing a stack of blank thermosensitive recording mediums. The controller may average the humidities detected by the first and second humidity sensors and correct the intensity of the laser beam emitted by the laser beam applying mechanism based on an average humidity.

Each of the above thermal recording devices may further comprise a heating mechanism for preheating the thermosensitive recording medium up to a predetermined temperature lower than a temperature at which the thermosensitive recording medium produces a color, before the laser beam is applied to the thermosensitive recording medium.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
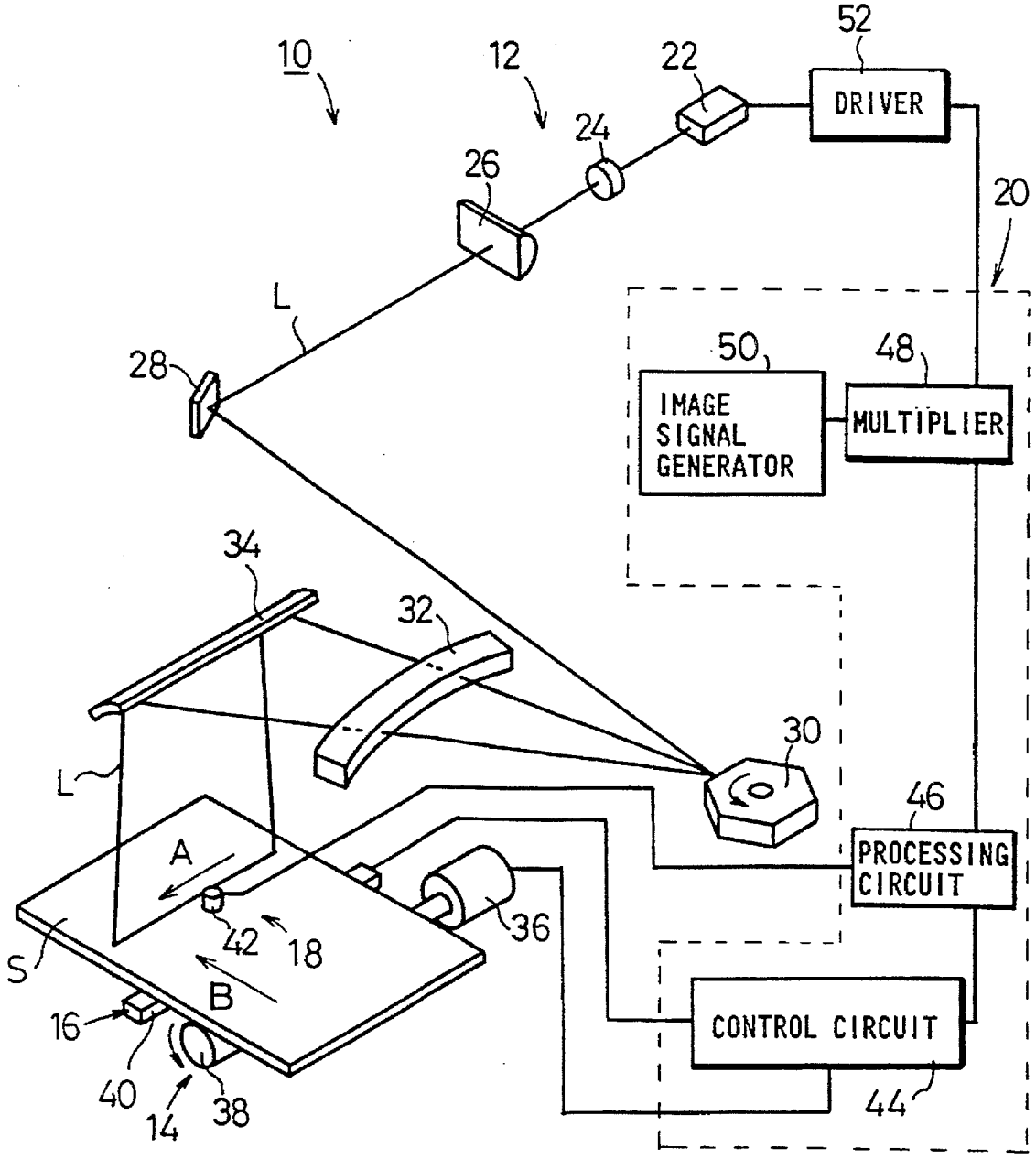
FIG. 1 is a block diagram, partly in perspective, of a thermal recording device according to a first embodiment of the present invention.
Figure 2:
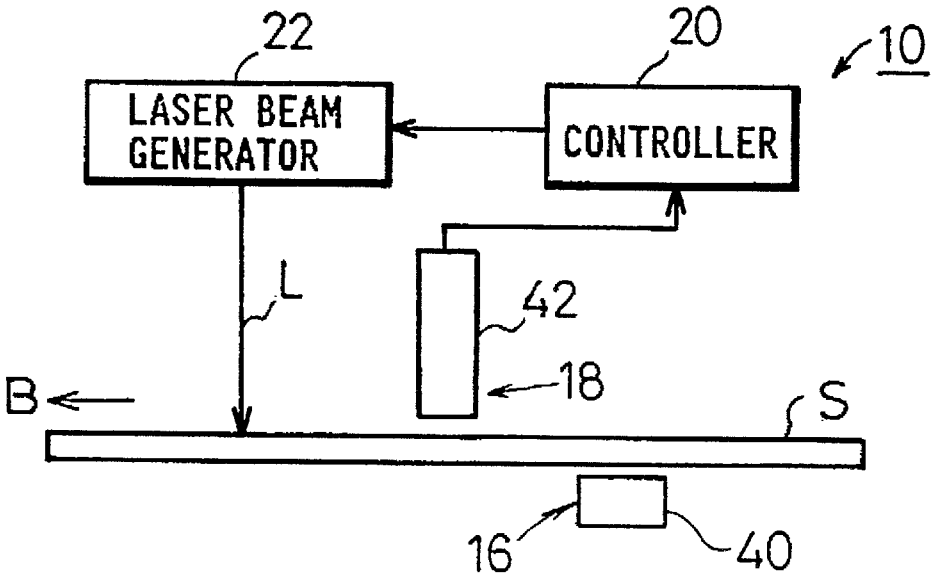
FIG. 2 is a schematic view, partly in block form, of a portion of the thermal recording device shown in FIG. 1.

As shown in FIGS. 1 and 2, a thermal recording device 10 according to a first embodiment of the present invention scans a laser beam L in the direction (main scanning direction) indicated by the arrow A over a thermosensitive recording medium S that is fed in the direction (auxiliary scanning direction) indicated by the arrow B for thereby recording an image or other information on the thermosensitive recording medium S. The thermosensitive recording medium S is a thermosensitive recording medium which comprises a coloring agent, a color developer, and a light absorbing dye on a support and which produces a color of a density which is commensurate with the level of a thermal energy applied thereto, as disclosed in Japanese patent application No. 3-62684 and Japanese laid-open patent publication No. 5-24219, for example.

The thermal recording device 10 comprises a laser beam applying mechanism 12 for applying the laser beam L that is scanned in the main scanning direction A to the thermosensitive recording medium S to impart a thermal energy to the thermosensitive recording medium S for thereby recording an image or other information thereon, an auxiliary scanning feed mechanism 14 for feeding the thermosensitive recording medium S in the auxiliary scanning direction B that is substantially perpendicular to the main scanning direction A, a heating mechanism 16 for preheating the thermosensitive recording medium S up to a predetermined temperature before the laser beam L is applied thereto, a temperature detecting mechanism 18 for detecting the temperature of the thermosensitive recording medium S, and a controller 20 for controlling the laser beam applying mechanism 12, the auxiliary scanning feed mechanism 14, and the heating mechanism 16 based on the temperature detected by the temperature detecting mechanism 18.

The laser beam applying mechanism 12 comprises a laser beam generator 22 for emitting the laser beam L, a cylindrical lens 26 for passing the laser beam L therethrough, a reflecting mirror 28 for reflecting the laser beam L, a polygonal mirror 30 for deflecting the laser beam L, an fθ lens 32 for passing the laser beam L therethrough, and a cylindrical mirror 26 for reflecting the laser beam L to correct a facet error of the polygonal mirror 30 in coaction with the cylindrical lens 26. The laser beam generator 22 may comprise a laser diode, a gas laser, or a semiconductor laser.

The auxiliary scanning feed mechanism 14 comprises a motor 36 and a feed roller 38 coupled to the motor 36 for feeding the thermosensitive recording medium S in the auxiliary scanning direction B.

The heating mechanism 16 comprises a heater 40 extending in the main scanning direction A and disposed below the thermosensitive recording medium S upstream of the area where the laser beam L is applied, for preheating the thermosensitive recording medium S up to a predetermined temperature before it is irradiated with and scanned by the laser beam L.

The temperature detecting mechanism 18 comprises a temperature sensor 42 such as an infrared radiation thermometer for detecting the temperature of the thermosensitive recording medium S near the area where an image or other information starts being recorded thereon. The temperature sensor 42 is connected to the controller 20.

The controller 20 comprises a control circuit 44 for controlling the motor 36 and the heater 40, a processing circuit 46 connected to the control circuit 44 for calculating a corrective value for an image signal based on the temperature detected by the temperature sensor 42, a multiplier 48 connected to the processing circuit 46, and an image signal generator 50 connected to the multiplier 48 for generating and supplying an image signal to the multiplier 48. The image signal is corrected with the corrective value by the multiplier 48, and the corrected image signal is supplied from the multiplier 48 to a driver 52, which energizes the laser beam generator 22.

Operation of the thermal recording device 10 according to the first embodiment will be described below.

When the motor 36 of the auxiliary scanning feed mechanism 14 is energized by the control circuit 44, the feed roller 38 coupled to the motor 36 rotates about its own axis in the direction indicated by the arrow, feeding the thermosensitive recording medium S in the auxiliary scanning direction B. At this time, the heater 40 of the heating mechanism 16 is energized by the control circuit 44 to preheat an area of the thermosensitive recording medium S which is not yet irradiated with the laser beam L up to a predetermined temperature that is lower than a temperature at which the thermosensitive recording medium S starts producing a color.

Before the laser beam generator 22 is energized by the driver 52 to apply the laser beam L to the thermosensitive recording medium, the temperature sensor 42 detects the temperature of the thermosensitive recording medium S itself. The temperature sensor 42 supplies a temperature signal indicative of the detected temperature to the processing circuit 46, which calculates an image signal corrective value for regulating the intensity of the laser beam L required to produce a desired color, based on the difference between the detected temperature of the thermosensitive recording medium S and a reference temperature that is the temperature at which the thermosensitive recording medium S starts producing a color.

The image signal corrective value thus calculated is supplied to the multiplier 48. The multiplier 48 is also supplied with an image signal representing an image or other information to be recorded on the thermosensitive recording medium S from the image signal generator 50. The multiplier 48 multiplies the image signal by the image signal corrective value, thus correcting the image signal. The corrected image signal is then supplied to the driver 52, which applies a drive signal to energize the laser beam generator 22 based on the corrected image signal. The laser beam generator 22 emits a laser beam L having a beam intensity that is corrected by a value corresponding to the difference between the detected temperature and the reference temperature and modulated by the image signal. The emitted laser beam L passes through the cylindrical lens 26 and is reflected by the reflecting mirror 28 toward the polygonal mirror 30. The polygonal mirror 30 which is rotating at high speed reflects and deflects the laser beam L with its mirror facets, and the reflected and deflected laser beam L passes through the fθ lens 32 and is reflected by the cylindrical mirror 34 toward the thermosensitive recording medium S. The laser beam L thus scans the thermosensitive recording medium S in the main scanning direction A while the thermosensitive recording medium S is being fed in the auxiliary scanning direction B, for thereby recording the image or other information thereon.

Concurrent with correcting the intensity of the laser beam L or instead of correcting the intensity of the laser beam L, the heater 40 may be controlled by the control circuit 44 to control the preheated temperature of the thermosensitive recording medium S to cause the temperature detected by the temperature sensor 42 to approach the reference temperature.

By thus correcting the intensity of the laser beam L emitted by the laser beam generator 22, it is possible to prevent the density of the color produced on the thermosensitive recording medium S from becoming irregular due to a change in the temperature of the thermosensitive recording medium S. For example, if the temperature of the thermosensitive recording medium S detected by the temperature sensor 42 is lower than the reference temperature, then the intensity of the laser beam L outputted from the laser beam generator 22 may be increased to cause the thermosensitive recording medium S to have a desired color producing temperature. Therefore, an image of a desired stable color density can be recorded on the thermosensitive recording medium S.

The intensity of the laser beam L may be varied by modulating the intensity with an acoustooptical modulator if the laser beam generator 22 comprises a gas laser or modulating the intensity by varying the current applied to the laser beam generator 22 if the laser beam generator 22 comprises a semiconductor laser. The intensity of the laser beam M emitted by a semiconductor laser may be modulated by adding a modulating signal to a bias current or supplying a pulse current.

The thermal recording device 10 according to the above embodiment has the heating mechanism 16 for preheating the thermosensitive recording medium S. However, it is possible to control the laser beam applying mechanism 12 if the thermal recording device 10 does not have the heating mechanism 16. This also holds true for other embodiments which will be described below.

Figure 4:
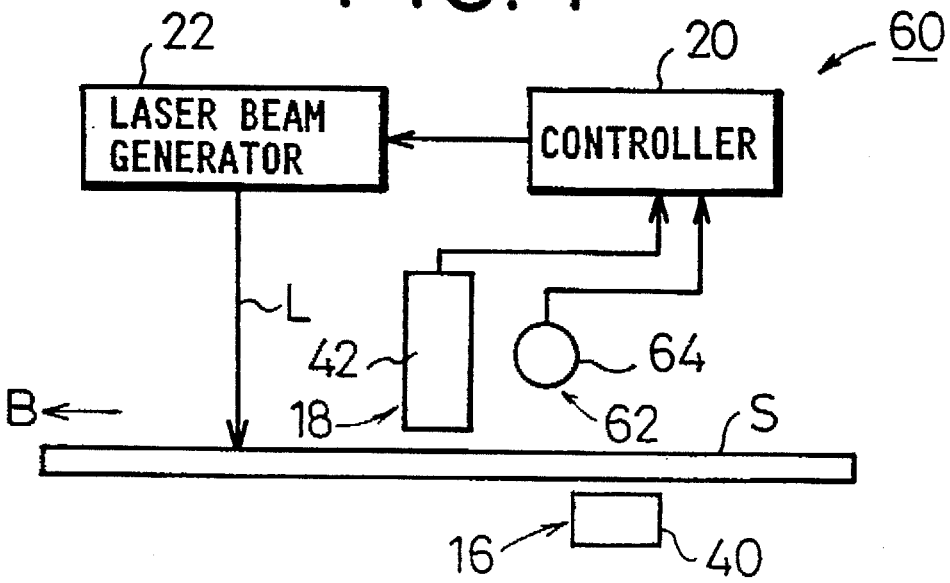
FIG. 4 is a schematic view, partly in block form, of a portion of the thermal recording device shown in FIG. 3.
Figure 3:
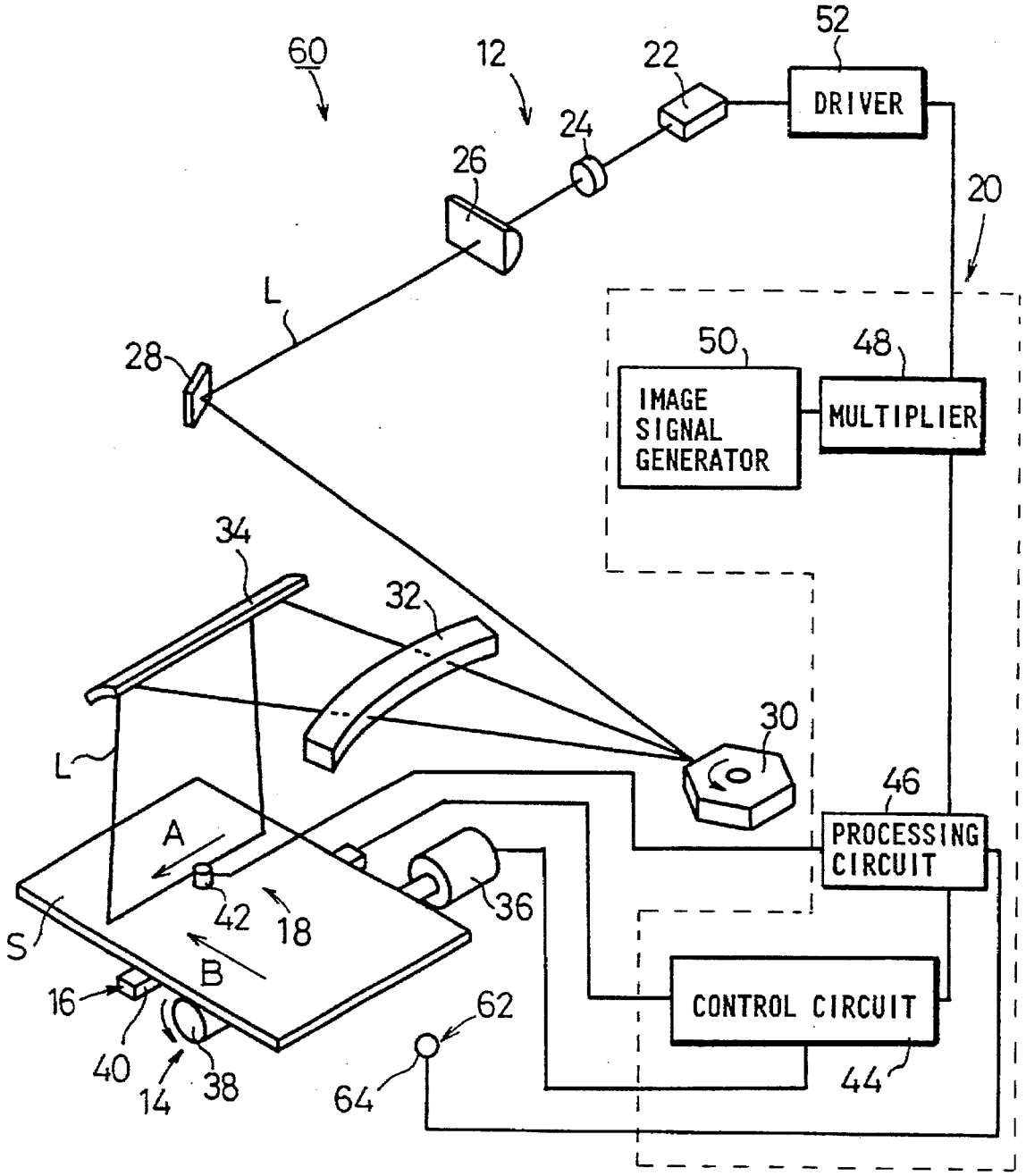
FIG. 3 is a block diagram, partly in perspective, of a thermal recording device according to a second embodiment of the present invention.

FIGS. 3 and 4 show a thermal recording device 10 according to a second embodiment of the present invention. Those parts shown in FIGS. 3 and 4 which are identical to those shown in FIGS. 1 and 2 are denoted by identical reference numerals, and will not be described in detail below.

The thermal recording device, generally denoted at 60, according to the second embodiment differs from the thermal recording device 10 according to the first embodiment in that the thermal recording device 60 additionally has an ambient temperature detecting mechanism 62 comprising a temperature sensor 64 for detecting the ambient temperature around the thermosensitive recording medium S. The temperature sensor 64 is connected to the processing circuit 46. The processing circuit 46 calculates a temperature gradient between the temperature in the vicinity of the recording area of the thermosensitive recording medium S where an image or other information is recorded and the temperature of that recording area of the thermosensitive recording medium S, based on the temperature, detected by the temperature sensor 42, of the thermosensitive recording medium S in the vicinity of the recording area and the ambient temperature, detected by the temperature sensor 64, around the thermosensitive recording medium S. It is possible to estimate the temperature of the recording area of the thermosensitive recording medium S based on the calculated temperature gradient.

More specifically, based on the temperature gradient that is calculated from the temperature of the thermosensitive recording medium S and the ambient temperature around the thermosensitive recording medium S, the control circuit 44 can predict, with high accuracy, the temperature of the thermosensitive recording medium S in the recording area where the laser beam L is applied. The processing circuit 46 supplies a signal indicative of the calculated temperature gradient to the multiplier 48, which corrects the image signal from the image signal generator 50. The corrected image signal is supplied from the controller 20 to the driver 52, which applies a drive signal to the laser beam generator 22. Since the intensity of the laser beam L generated by the laser beam generator 22 is modulated depending on the temperature of the recording area of the thermosensitive recording medium S, it is possible for the thermal recording device 60 to record a highly accurate and stable image or other information on the thermosensitive recording medium S.

Therefore, even when the temperature of the thermosensitive recording medium S varies, a desired image density can be achieved by correcting the intensity of the laser beam emitted by the laser beam generator 22 and/or the thermal output from the heater 16 based on the varying temperature of the thermosensitive recording medium S. As a result, the thermal recording device 60 can prevent the density of the color produced on the thermosensitive recording medium S from becoming irregular due to a change in the temperature of the thermosensitive recording medium S. Inasmuch as the temperature is corrected, it is possible to record an image of a stable density at all times.

Figure 5:
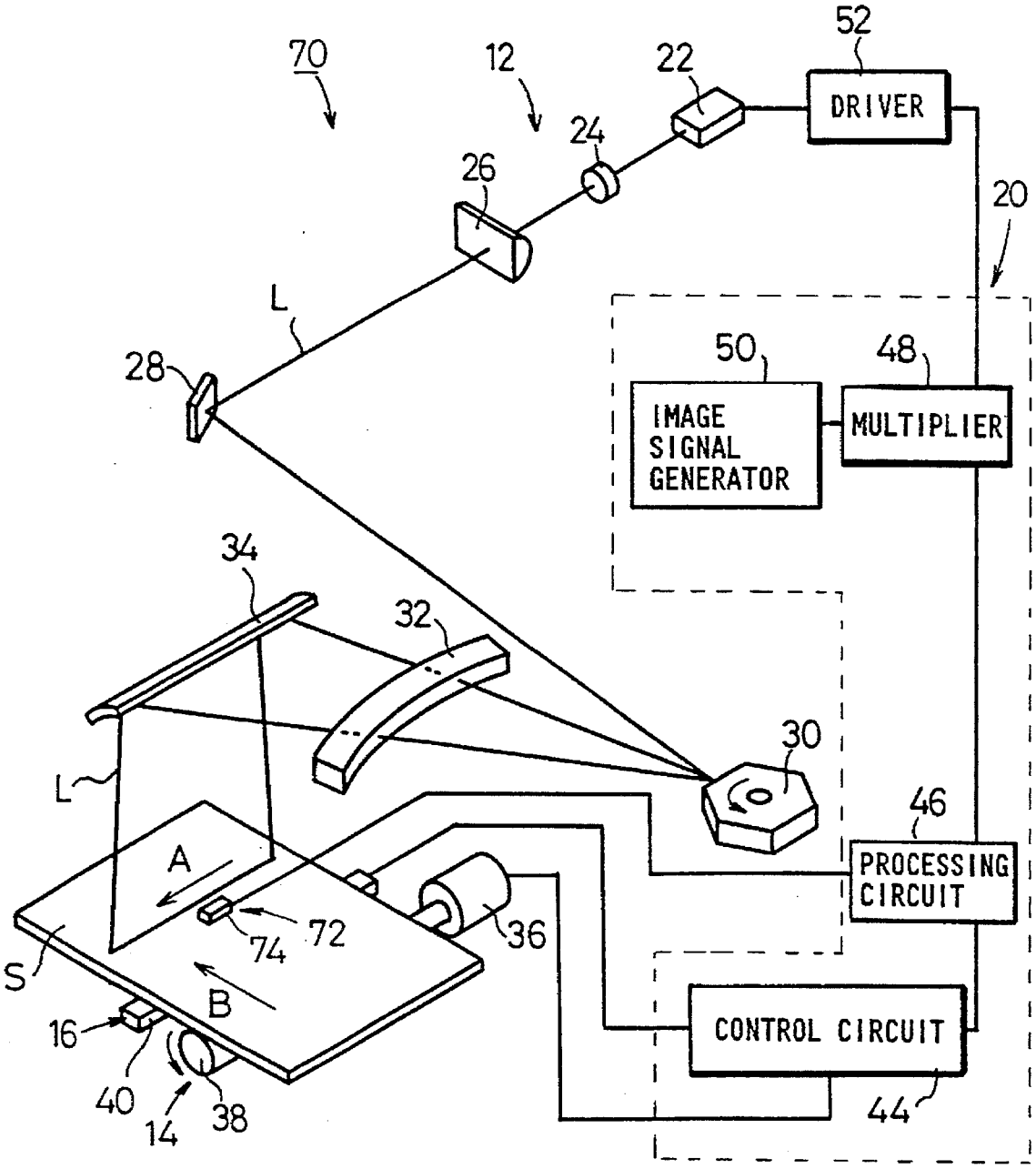
FIG. 5 is a block diagram, partly in perspective, of a thermal recording device according to a third embodiment of the present invention.

FIG. 5 shows a thermal recording device 70 according to a third embodiment of the present invention. Those parts shown in FIG. 5 which are identical to those shown in FIGS. 1 and 2 are denoted by identical reference numerals, and will not be described in detail below.

The thermal recording device 70 has a humidity detecting mechanism 72, in place of the temperature detecting mechanism 18. The humidity detecting mechanism 72 comprises a humidity sensor 74 for detecting the humidity in the atmosphere in the vicinity of an area where the laser beam L is applied to the thermosensitive recording medium S. The humidity sensor 74 is connected to the processing circuit 46.

The humidity in the atmosphere in the vicinity of the area where the laser beam L is applied to the thermosensitive recording medium S is detected by the humidity sensor 74, and the detected humidity is supplied to the processing circuit 46. The processing circuit 46 calculates an image signal corrective value based on the humidity vs. sensitivity characteristics of the thermosensitive recording medium S, from the detected humidity. The processing circuit 46 supplies a signal indicative of the calculated image signal corrective value to the multiplier 48, which is also supplied with an image signal representing an image or other information to be recorded on the thermosensitive recording medium S from the image signal generator 50. The multiplier 48 multiplies the image signal by the image signal corrective value, thus producing a corrected image signal. The corrected image signal is supplied to the driver 52, which applies a drive signal to the laser beam generator 22. The laser beam generator 22 outputs a laser beam L with an regulated intensity.

If the humidity detected by the humidity sensor 74 is relatively high, the controller 20 controls the driver 52 to enable the laser beam generator 22 to emit a laser beam L with a relatively low intensity. Since the water content of the thermosensitive recording medium S and its sensitivity are relatively high when the humidity is relatively high, the intensity of the laser beam L applied to the thermosensitive recording medium S is lowered to record an image or other information of a desired gradation or density on the thermosensitive recording medium S. If the humidity detected by the humidity sensor 74 is relatively low, the controller 20 controls the driver 52 to enable the laser beam generator 22 to emit a laser beam L with a relatively high intensity, thus recording an image of a desired gradation or density on the thermosensitive recording medium S whose sensitivity is relatively low because of the low humidity.

Consequently, even when the sensitivity of the thermosensitive recording medium S varies due to a change in the humidity, the intensity of the laser beam L emitted from the laser beam generator 22 is regulated to compensate for the varying sensitivity of the thermosensitive recording medium S with high accuracy.

In FIG. 5, a temperature sensor for detecting the temperature of the thermosensitive recording medium S in its recording area may be combined with the humidity sensor 74, so that the laser beam L can be corrected with respect to the humidity and the heater 40 can be controlled by the control circuit 44 based on the detected temperature to control the preheated temperature of the thermosensitive recording medium S.

A thermal recording device 80 shown in FIG. 6 according to a fourth embodiment of the present invention will be described below. Those parts shown in FIG. 6 which are identical to those shown in FIG. 5 are denoted by identical reference numerals, and will not be described in detail below.

Figure 6:
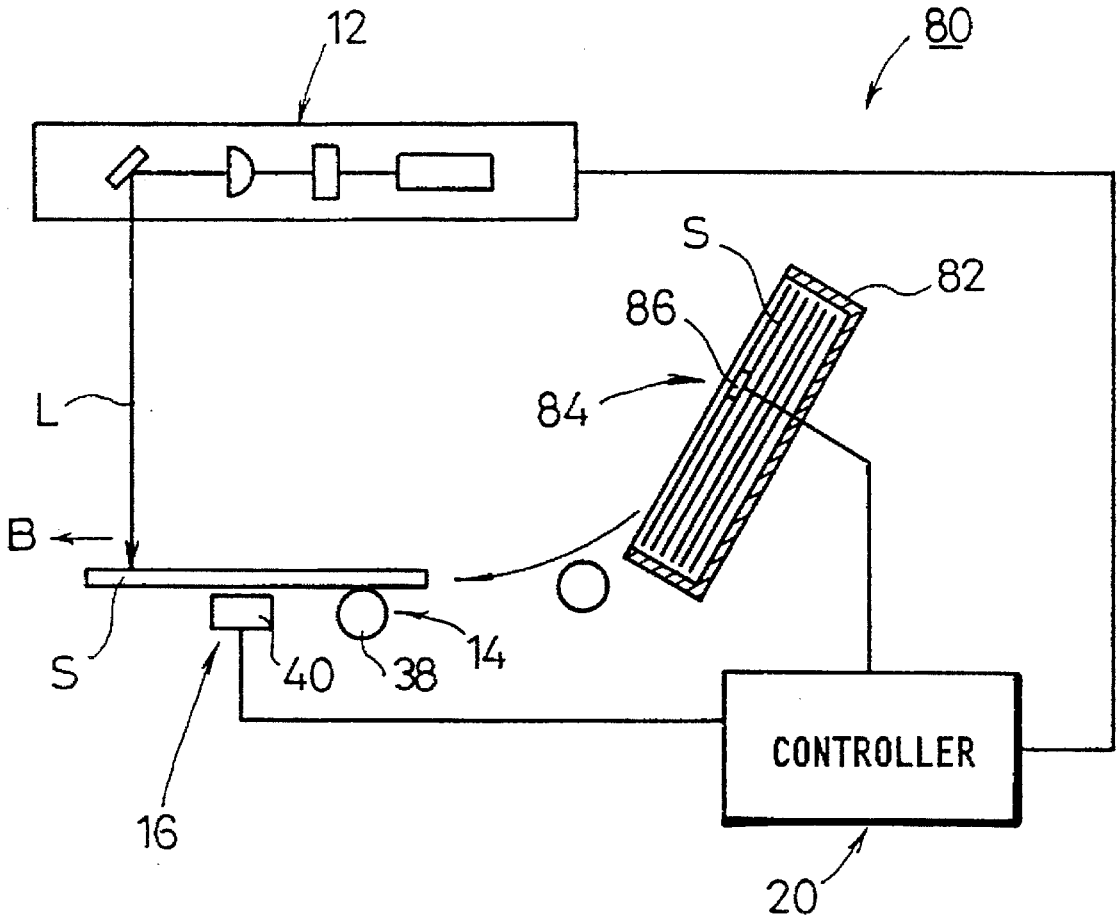
FIG. 6 is a schematic side elevational view, partly in block form of a thermal recording device according to a fourth embodiment of the present invention.

As shown in FIG. 6, the thermal recording device 80 has a magazine 82 for storing a stack of blank thermosensitive recording mediums S which have not yet been recorded, and a humidity detecting mechanism 84 comprising a humidity sensor 86 for detecting humidity is disposed in the magazine 82. A sheet feeding mechanism (not shown) is positioned between the magazine 82 and the auxiliary scanning feed mechanism 14 for taking the stacked thermosensitive recording mediums S, one at a time, from the magazine 82.

It is practical to provide the magazine 82 with the humidity sensor 86, because the speed of variation in the sensitivity of the thermosensitive recording medium due to humidity is slow.

Figure 7:
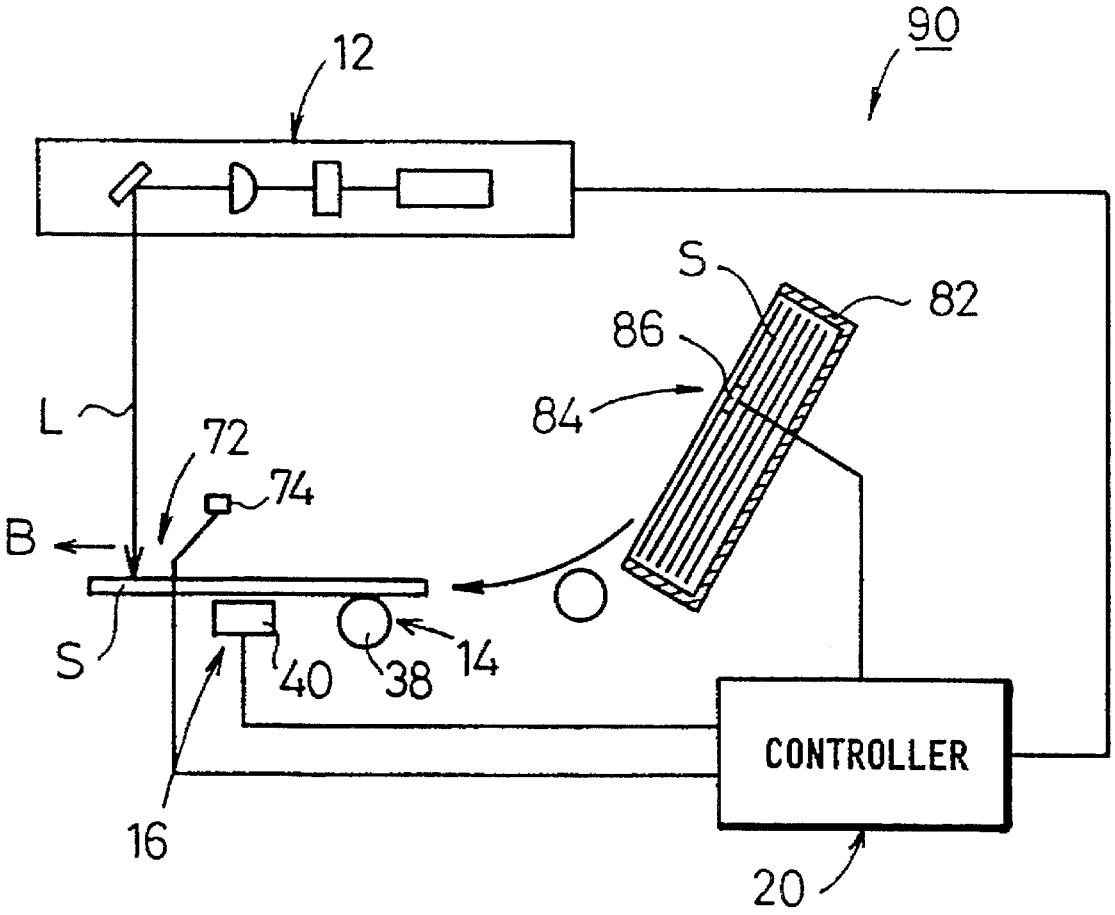
FIG. 7 is a schematic side elevational view, partly in block form of a thermal recording device according to a fifth embodiment of the present invention.

A thermal recording device 90 shown in FIG. 7 according to a fifth embodiment of the present invention will be described below.

The thermal recording device 90 is a combination of the third embodiment shown in FIG. 5 and the fourth embodiment shown in FIG. 6. Accordingly, equal elements in the fifth embodiment are given equal reference numerals as in the third and fourth embodiments.

The humidity in the atmosphere in the magazine 82 in which the thermosensitive recording mediums S are stacked is detected by the humidity sensor 86, and the humidity in the atmosphere near the area where the laser beam L is applied to the thermosensitive recording medium S is detected by the humidity sensor 74. The controller 20 calculates the gradient between humidities detected by the humidity sensors 86 and 74, and corrects an image signal based on an estimated humidity according to the calculated humidity gradient, at the position where the laser beam is applied to the thermosensitive recording medium. Therefore, a more precise correction of the image signal than otherwise for the variation in the sensitivity of the thermosensitive recording medium is carried out based on a more precise moisture content obtained by considering the both humidity values in the stack of the thermosensitive recording medium in the magazine 82 and in the atmosphere near where the laser beam is applied to the thermosensitive recording medium.

Figure 8:
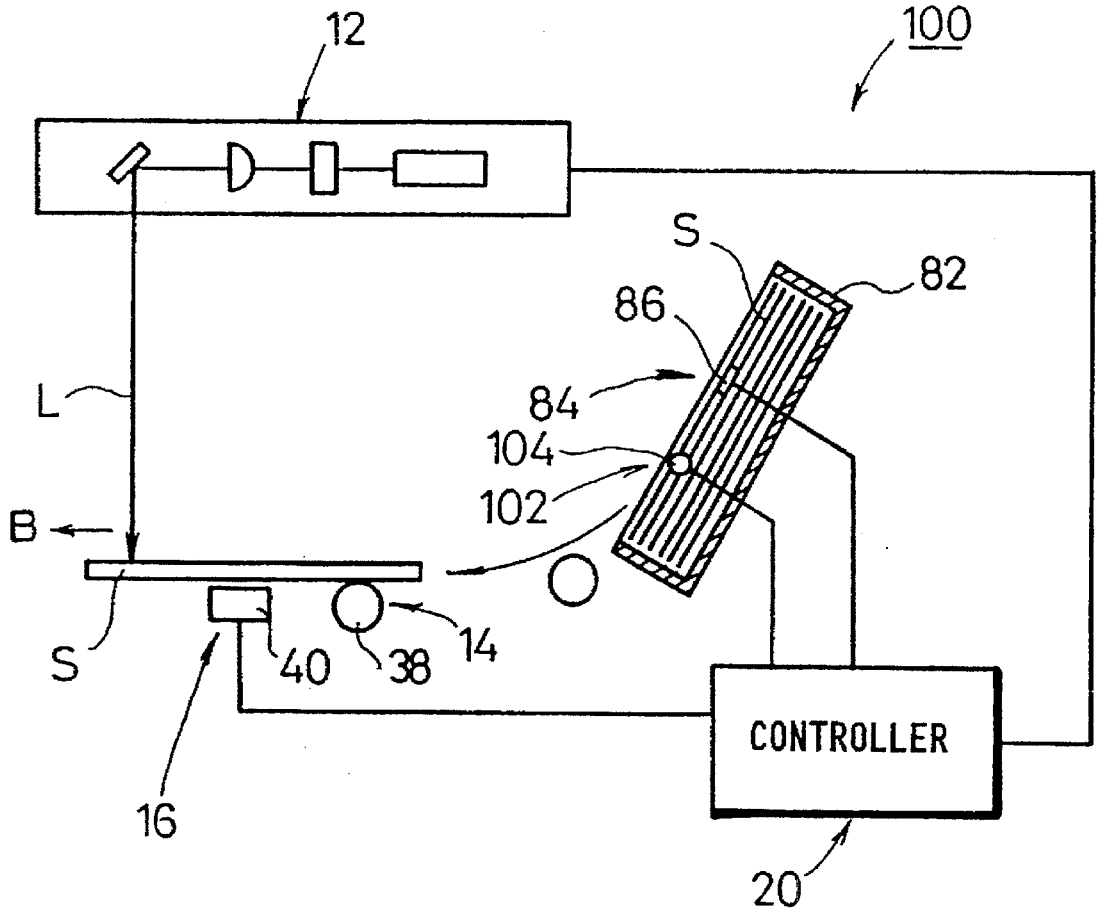
FIG. 8 is a schematic side elevational view, partly in block form of a thermal recording device according to a sixth embodiment of the present invention.

A thermal recording device 100 shown in FIG. 8 according to a sixth embodiment of the present invention will be described below.

Figure 9:
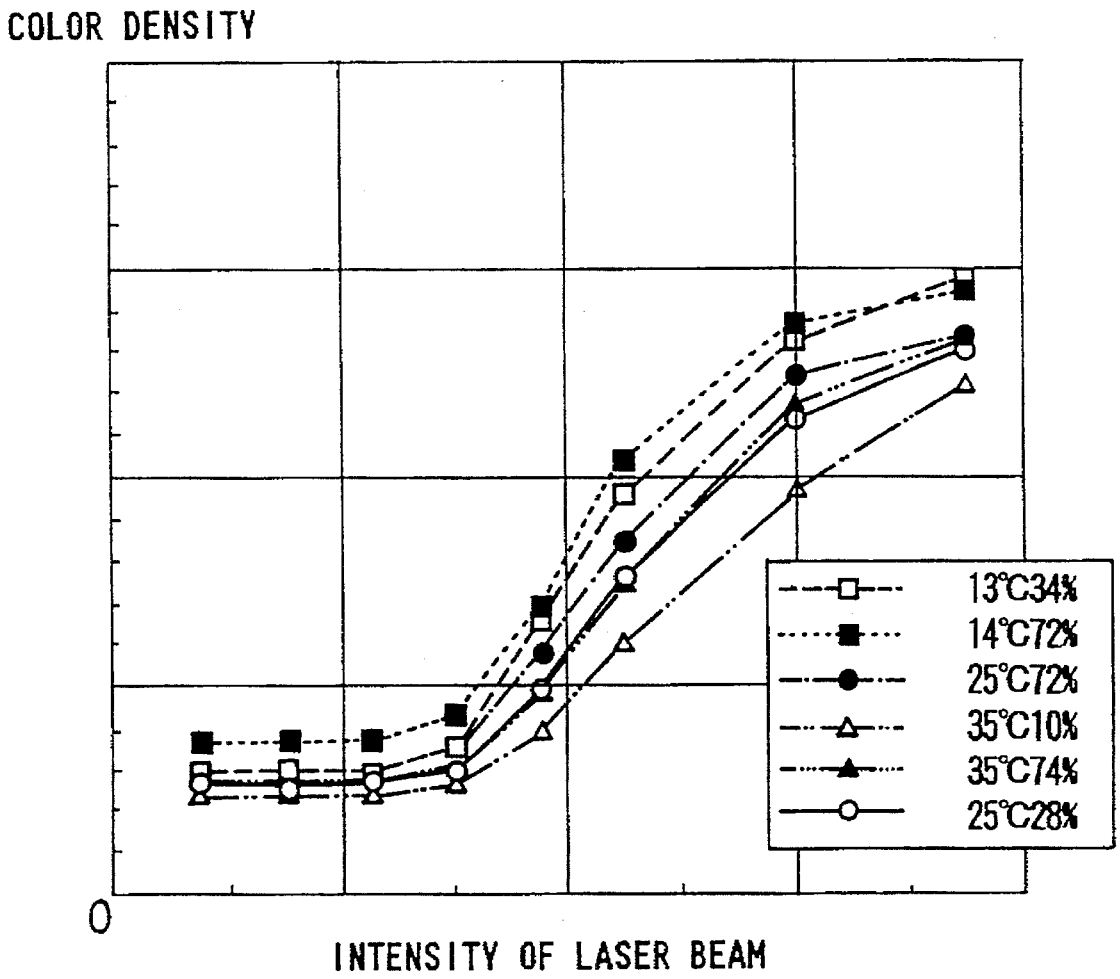
FIG. 9 is a graph showing the relationship between the intensity of the laser beam and the resultant color density.

The sixth embodiment differs from the fourth embodiment shown in FIG. 6 in that a temperature sensor 104 is comprised in the thermal recording device 100, which constitutes a temperature detecting mechanism 102 for detecting the temperature in a stack of the thermosensitive recording medium. In the thermal recording device 100, a controller 20 is inputted with the temperature in the stack of the thermosensitive recording medium detected by the temperature sensor 104 and the humidity in the stack of the thermosensitive recording medium detected by the humidity sensor 86. The controller 20 produces a correction table based on the inputted temperature, humidity and relationships (see FIG. 9) stored in advance between the intensity of the laser beam and the resultant color density, and corrects the intensity of the laser beam emitted by the laser beam applying mechanism and/or the predetermined temperature produced by the heating mechanism, based on the correction table.

It is needless to say that a further precise recording of images and the like is made possible if a combination of the second and third embodiments or the second and fourth embodiments described above is produced.

Although certain preferred embodiments of the present invention has been shown and described in detail, it should be understood that various changes and modifications may be made therein without departing from the scope of the appended claims.

What is claimed is:

1. A thermal recording device, comprising:

a thermosensitive recording medium which comprises a support coated with a coloring agent, a color developer, and a light absorbing dye and which produces a color having a density commensurate with the level of a thermal energy applied thereto, thereby to record an image thereon;

a laser beam applying mechanism for emitting and applying a laser beam modulated by an image signal to be recorded to the thermosensitive recording medium;

a temperature detecting mechanism for detecting a temperature with respect to the thermosensitive recording medium;

a humidity detecting mechanism for detecting a humidity with respect to the thermosensitive recording medium; and a controller for correcting the intensity of the laser beam emitted by said laser beam applying mechanism based on the temperature detected by said temperature detecting mechanism and the humidity detected by said humidity detecting mechanism.

2. A thermal recording device for scanning a laser beam over a thermosensitive recording medium which comprises a support coated with a coloring agent, a color developer, and a light absorbing dye and produce a color having a density commensurate with the level of a thermal energy applied thereto, thereby to record an image thereon, said thermal recording device comprising:

a laser beam applying mechanism for emitting and applying a laser beam modulated by an image signal to be recorded to the thermosensitive recording medium;

a heating mechanism for preheating the thermosensitive recording medium, before the laser beam is applied thereto, up to a predetermined temperature lower than a temperature at which the thermosensitive recording medium produces a color;

a temperature detecting mechanism for detecting a temperature with respect to the thermosensitive recording medium;

a humidity detecting mechanism for detecting a humidity with respect to the thermosensitive recording medium;

a controller for correcting the intensity of the laser beam emitted by said laser beam applying mechanism and/or the predetermined temperature produced by the heating mechanism based on the temperature detected by said temperature detecting mechanism and the humidity detected by said humidity detecting mechanism.

3. A thermal recording device, comprising:

a thermosensitive recording medium which comprises a support coated with a coloring agent, a color developer, and a light absorbing dye and which produces a color having a density commensurate with the level of a thermal energy applied thereto, thereby to record an image thereon;

a laser beam applying mechanism for emitting and applying a laser beam modulated by an image signal to be recorded to the thermosensitive recording medium;

a temperature detecting mechanism for detecting a temperature with respect to the thermosensitive recording medium; and a controller for correcting the intensity of the laser beam emitted by said laser beam applying mechanism based on the temperature detected by said temperature detecting mechanism.

4. A thermal recording device for scanning a laser beam over a thermosensitive recording medium which comprises a support coated with a coloring agent, a color developer, and a light absorbing dye and produce a color having a density commensurate with the level of a thermal energy applied thereto, thereby to record an image thereon, said thermal recording device comprising:

a laser beam applying mechanism for emitting and applying a laser beam modulated by an image signal to be recorded to the thermosensitive recording medium;

a heating mechanism for preheating the thermosensitive recording medium, before the laser beam is applied thereto, up to a predetermined temperature lower than a temperature at which the thermosensitive recording medium produces a color;

a temperature detecting mechanism for detecting a temperature with respect to the thermosensitive recording medium;

a controller for correcting the intensity of the laser beam emitted by said laser beam applying mechanism and/or the predetermined temperature produced by the heating mechanism based on the temperature detected by said temperature detecting mechanism.

5. A thermal recording device according to claim 1, wherein:

said temperature detecting mechanism comprises a first temperature sensor for detecting the temperature of said thermosensitive recording medium, and a second temperature sensor for detecting an ambient temperature in an atmosphere around said thermosensitive recording medium; and said controller comprises means for estimating a temperature in an area where the laser beam is applied to the thermosensitive recording medium from a temperature gradient between the temperatures detected by said first and second temperature sensors, and corrects the intensity of the laser beam emitted by said laser beam applying mechanism and/or the predetermined temperature produced by the heating mechanism based on the estimated temperature.

6. A thermal recording device according to claim 3, wherein:

said temperature detecting mechanism comprises a first temperature sensor for detecting the temperature of said thermosensitive recording medium, and a second temperature sensor for detecting an ambient temperature in an atmosphere around said thermosensitive recording medium; and said controller comprises means for estimating a temperature in an area where the laser beam is applied to the thermosensitive recording medium from a temperature gradient between the temperatures detected by said first and second temperature sensors, and corrects the intensity of the laser beam emitted by said laser beam applying mechanism and/or the predetermined temperature produced by the heating mechanism based on the estimated temperature.

7. A thermal recording device according to claim 1, wherein said controller comprises:

a processing circuit for calculating a corrective value based on the temperature detected by said temperature detecting mechanism;

an image signal generator for generating an image signal representative of the image to be recorded;

a multiplier for multiplying the image signal by the corrective value thereby to produce a corrected image signal; and a control circuit for driving said laser beam emitting mechanism based on the corrected image signal.

8. A thermal recording device according to claim 3, wherein said controller comprises:

a processing circuit for calculating a corrective value based on the temperature detected by said temperature detecting mechanism;

an image signal generator for generating an image signal representative of the image to be recorded;

a multiplier for multiplying the image signal by the corrective value thereby to produce a corrected image signal; and a control circuit for driving said laser beam emitting mechanism based on the corrected image signal.

9. A thermal recording device, comprising:

a thermosensitive recording medium which comprises a support coated with a coloring agent, a color developer, and a light absorbing dye and which produces a color having a density commensurate with the level of a thermal energy applied thereto, thereby to record an image thereon;

a laser beam applying mechanism for emitting and applying a laser beam modulated by an image signal to be recorded to the thermosensitive recording medium;

a humidity detecting mechanism for detecting a humidity with respect to the thermosensitive recording medium;

a controller for correcting the intensity of the laser beam emitted by said laser beam applying mechanism based on the humidity detected by said humidity detecting mechanism.

10. A thermal recording device for scanning a laser beam over a thermosensitive recording medium which comprises a support coated with a coloring agent, a color developer, and a light absorbing dye and produce a color having a density commensurate with the level of a thermal energy applied thereto, thereby to record an image thereon, said thermal recording device comprising:

a laser beam applying mechanism for emitting and applying a laser beam modulated by an image signal to be recorded to the thermosensitive recording medium;

a heating mechanism for preheating the thermosensitive recording medium, before the laser beam is applied thereto, up to a predetermined temperature lower than a temperature at which the thermosensitive recording medium produces a color;

a humidity detecting mechanism for detecting a humidity with respect to the thermosensitive recording medium;

a controller for correcting the intensity of the laser beam emitted by said laser beam applying mechanism and/or the predetermined temperature produced by the heating mechanism based on the humidity detected by said humidity detecting mechanism.

11. A thermal recording device according to claim 1, wherein said humidity detecting mechanism comprises a magazine humidity sensor for detecting a humidity in a magazine for storing a stack of blank thermosensitive recording mediums.

12. A thermal recording device according to claim 9, wherein said humidity detecting mechanism comprises a magazine humidity sensor for detecting a humidity in a magazine for storing a stack of blank thermosensitive recording mediums.

13. A thermal recording device according to claim 1, wherein said controller comprises:

a processing circuit for calculating a corrective value based on the humidity detected by said humidity detecting mechanism;

an image signal generator for generating an image signal representative of the image to be recorded;

a multiplier for multiplying the image signal by the corrective value thereby to produce a corrected image signal; and a control circuit for driving said laser beam emitting mechanism based on the corrected image signal.

14. A thermal recording device according to claim 9, wherein said controller comprises:

a processing circuit for calculating a corrective value based on the humidity detected by said humidity detecting mechanism;

an image signal generator for generating an image signal representative of the image to be recorded;

a multiplier for multiplying the image signal by the corrective value thereby to produce a corrected image signal; and a control circuit for driving said laser beam emitting mechanism based on the corrected image signal.

15. A thermal recording device according to claim 1, wherein:

said humidity detecting mechanism comprises a first humidity sensor for detecting a humidity in an atmosphere in an area where the laser beam is applied to the thermosensitive recording medium and a second humidity sensor for detecting a humidity in a magazine for storing a stack of blank thermosensitive recording mediums; and said controller comprises means for estimating a humidity in an area where the laser beam is applied to the thermosensitive recording medium from a humidity gradient between the humidities detected by said first and second humidity sensors, and corrects the intensity of the laser beam emitted by said laser beam applying mechanism based on the estimated humidity.

16. A thermal recording device according to claim 9, wherein:

said humidity detecting mechanism comprises a first humidity sensor for detecting a humidity in an atmosphere in an area where the laser beam is applied to the thermosensitive recording medium and a second humidity sensor for detecting a humidity in a magazine for storing a stack of blank thermosensitive recording mediums; and said controller comprises means for estimating a humidity in an area where the laser beam is applied to the thermosensitive recording medium from a humidity gradient between the humidities detected by said first and second humidity sensors, and corrects the intensity of the laser beam emitted by said laser beam applying mechanism based on the estimated humidity.

17. A thermal recording device according to claim 2, wherein:

said humidity detecting mechanism comprises a first humidity sensor for detecting a humidity in an atmosphere in an area where the laser beam is applied to the thermosensitive recording medium and a second humidity sensor for detecting a humidity in a magazine for storing a stack of blank thermosensitive recording mediums; and said controller comprises means for estimating a humidity in an area where the laser beam is applied to the thermosensitive recording medium from a humidity gradient between the humidities detected by said first and second humidity sensors, and corrects the intensity of the laser beam emitted by said laser beam applying mechanism and/or the predetermined temperature produced by the heating mechanism based on the estimated humidity.

18. A thermal recording device according to claim 10, wherein:

said humidity detecting mechanism comprises a first humidity sensor for detecting a humidity in an atmosphere in an area where the laser beam is applied to the thermosensitive recording medium and a second humidity sensor for detecting a humidity in a magazine for storing a stack of blank thermosensitive recording mediums; and said controller comprises means for estimating a humidity in an area where the laser beam is applied to the thermosensitive recording medium from a humidity gradient between the humidities detected by said first and second humidity sensors, and corrects the intensity of the laser beam emitted by said laser beam applying mechanism and/or the predetermined temperature produced by the heating mechanism based on the estimated humidity.

19. A thermal recording device according to claim 3, wherein said temperature detecting mechanism comprises a temperature sensor for detecting the temperature of said thermosensitive recording medium.

20. A thermal recording device according to claim 3, further comprising a heating mechanism for preheating the thermosensitive recording medium up to a predetermined temperature which is lower than a temperature at which the thermosensitive recording medium produces a color, before the laser beam is applied to the thermosensitive recording medium.

21. A thermal recording device according to claim 3, wherein said controller comprises a processing circuit for calculating a corrective value based on the temperature detected by said temperature detecting mechanism, an image signal generator for generating an image signal representative of the image to be recorded, and a multiplier for multiplying the image signal by the corrective value thereby producing a corrected image signal, and wherein the thermal recording device further comprises means for energizing said laser beam applying mechanism with said corrected image signal.

22. A thermal recording device according to claim 9, wherein said humidity detecting mechanism comprises a humidity sensor for detecting a humidity in an atmosphere in an area where the laser beam is applied to the thermosensitive recording medium.

23. A thermal recording device according to claim 9, further comprising a magazine for storing a stack of blank thermosensitive recording mediums, wherein said humidity detecting mechanism comprises a first humidity sensor for detecting a humidity in an atmosphere in an area where the laser beam is applied to the thermosensitive recording medium, and a second humidity sensor for detecting a humidity in said magazine, and wherein said controller comprises means for averaging the humidities detected by said first and second humidity sensors and correcting the intensity of the laser beam emitted by said laser beam applying mechanism based on the average humidity.

24. A thermal recording device according to claim 9, further comprising a heating mechanism for preheating the thermosensitive recording medium up to a predetermined temperature lower than a temperature at which the thermosensitive recording medium produces a color, before the laser beam is applied to the thermosensitive recording medium.

* * * * *